US006376755B1

(12) United States Patent
Kammerer

(10) Patent No.: US 6,376,755 B1
(45) Date of Patent: Apr. 23, 2002

(54) GUITAR CONSTRUCTION

(76) Inventor: Jon D. Kammerer, 80 N. 4th St., Hamilton, IL (US) 62341

( * ) Notice: Subject to any disclaimer, the term of this patent is extended or adjusted under 35 U.S.C. 154(b) by 0 days.

(21) Appl. No.: 09/667,087

(22) Filed: Sep. 21, 2000

(51) Int. Cl.[7] ..... G10D 3/00
(52) U.S. Cl. ..... 84/290; 84/291
(58) Field of Search ..... 84/290, 291, 267, 84/275, 292

(56) References Cited

U.S. PATENT DOCUMENTS

| | | | | | |
|---|---|---|---|---|---|
| 4,320,684 | A | * | 3/1982 | Podunavac | 84/291 |
| 4,903,567 | A | * | 2/1990 | Justus | 84/294 |
| D384,690 | S | * | 10/1997 | Litarwich | D17/20 |
| 5,889,221 | A | * | 3/1999 | Dejima | 84/291 |
| 5,895,872 | A | * | 4/1999 | Chase | 84/291 |
| 5,945,614 | A | * | 8/1999 | White | 84/267 |
| 5,952,591 | A | * | 9/1999 | Thurman | 84/267 |
| 6,025,548 | A | * | 2/2000 | Ehrlich | 84/291 |

OTHER PUBLICATIONS

Redesign of Acoustic Stringed Instrument Using Alternative Materials and Shapes, Kammerer, May 3, 1995.

* cited by examiner

*Primary Examiner*—Robert E. Nappi
*Assistant Examiner*—Kim Lockett
(74) *Attorney, Agent, or Firm*—Parsons & Goltry; Michael W. Goltry; Robert A. Parsons

(57) ABSTRACT

A guitar including a neck including a head and an opposing end attached to a sound box and strings extending between the head and a bridge carried by the sound box, the sound box having a sound hole leading to a sound chamber that is defined by an inner surface including opposing generally concave faces that meet at a substantially continuous and parabolic face.

26 Claims, 2 Drawing Sheets

10
11
12
13
14
15
16
17
18
20
21
22
23
24
25
26
30
30A
30B
31
31A
31B
32
60
A
5

GUITAR CONSTRUCTION

FIELD OF THE INVENTION

This invention relates to string instruments and, more particularly, to a new and improved guitar construction.

BACKGROUND OF THE INVENTION

A musician is no better than the instrument he plays. It is no good to have the best talent and an abundance of musical knowledge and skill if, when music is played, sound suffers in quality and carry. The musician must therefore pay close attention to his instrument and to its cleanliness and construction.

Guitars vary as much in shape and design as they do in structure. The structure of guitars normally translates into the sound that resonates from its belly or sound box. In fact, musicians spend considerable time trying to invent their own original sound, which for many often starts with a unique guitar construction. Although the art is replete with guitars that embody the past efforts of musical artisans, needed is still another improvement in the art of guitars for providing improved sound quality and carry and greater sound generation.

SUMMARY OF THE INVENTION

The above problems and others are at least partially solved and the above purposes and others realized in new and improved guitar including a neck having a head and an opposing end attached to a sound box. The sound box includes a sound opening the leads to a sound chamber, and strings extend between the head and a bridge carried by the sound box and over the sound hole. The sound chamber is defined by an inner surface of the sound box. The inner surface includes generally concave or bowl-shaped faces that meet at and defined a substantially continuous and parabolic face. The sound box and the neck can each be integrally formed or fabricated as an assemblage of many elements. The neck and at least a portion of the sound box leading to the sound hole carry or otherwise support a fingerboard. The fingerboard is equipped with frets and position marks. The sound box defines upper and lower bouts separated by a waist, and the lower bout includes opposing thumbs. One of the thumbs supports a pickup jack that leads into or is otherwise associated with the sound chamber. The sound jack is for receiving and transmitting sound to a sound amplifier or other external device. The opposing end of the neck is attached to a heel block carried by the sound box, and the heel block is preferably contained within the sound chamber.

BRIEF DESCRIPTION OF THE DRAWINGS

Referring to the drawings.

DETAILED DESCRIPTION OF A PREFERRED EMBODIMENT

Figures 1, 2, 3:
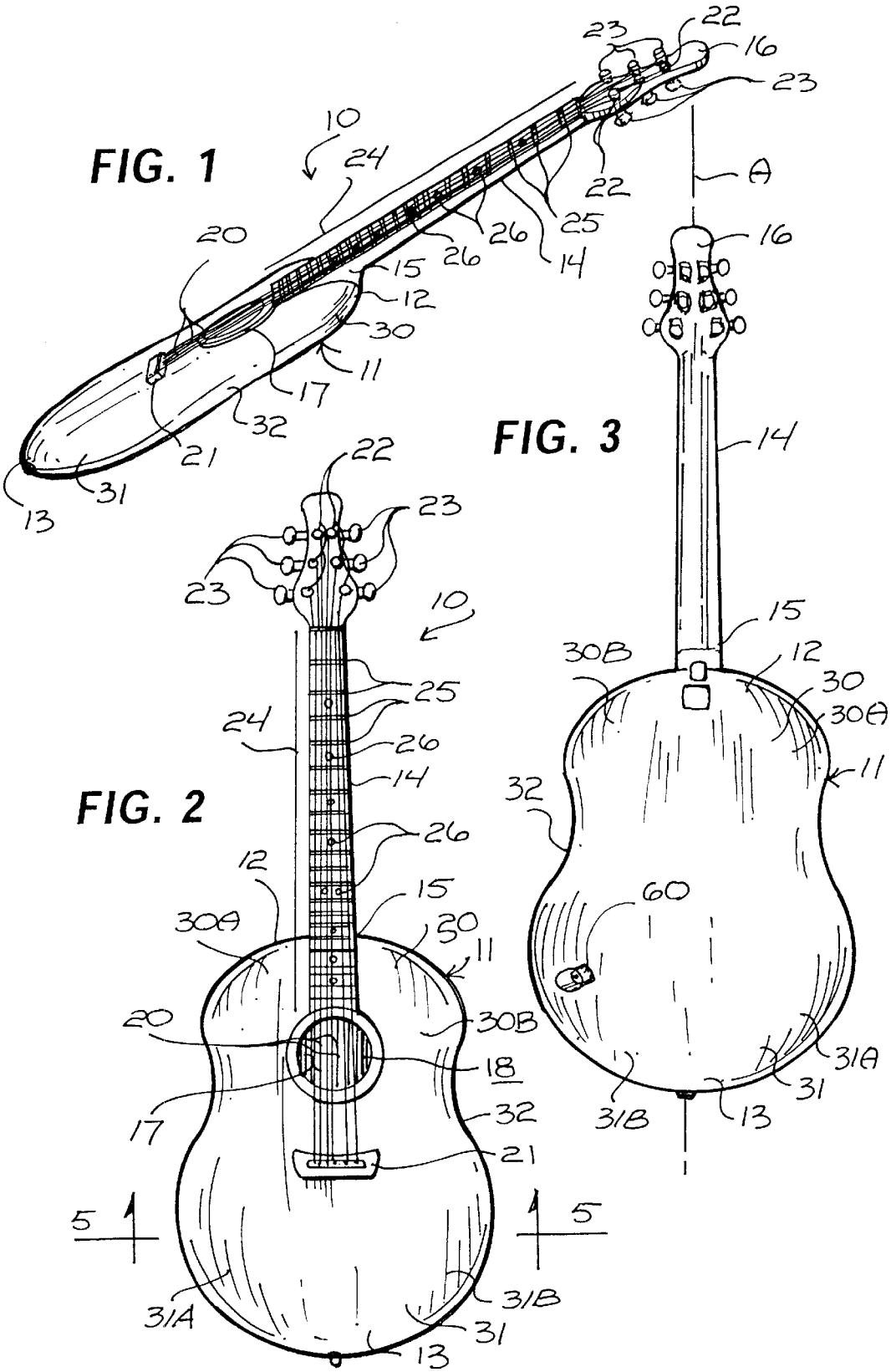
FIG. 1 is a perspective view of a guitar constructed in accordance with the invention, the guitar having a sound box and an attached neck.
FIG. 2 is a front view of the guitar of FIG. 1.
FIG. 3 is a rear view of the guitar of FIG. 1.

Turning to the drawings, FIG. 1 illustrates a perspective view of a guitar 10 constructed in accordance with the invention. With additional attention directed to FIG. 2, guitar 10 includes a sound box 11 having a sound hole 17 that leads to a sound chamber 18 (FIG. 2), upper and lower ends 12 and 13 and a neck 14 having a head 16 and an opposing end 15 attached at upper end 12. Sound box can be constructed or otherwise formed with wood, molded plastic, fiberglass, superimposed and laminated layers of plastic, fiberglass, wood or the like, and neck is constructed of wood and/or aluminum or other relatively rigid material or combination of materials Strings 20 are supported by and extend between head 16 and a bridge 21 carried by sound box 11 and over sound hole 17. Bridge 21 is preferably pocketed into sound box 11. As a matter of orientation, upper ends of strings 20 are attached to head 16 and lower ends of strings 20 are attached to bridge 21. The lower ends of strings 20 are preferably wrapped around bridge 21 and this eliminates the need for bridge pins and helps transmit sound waves to the surface of guitar 10, which enhances the ability of sound box 11 to resonate. The upper ends of strings 20 are attached to adjustable posts 22 mounted to head 16. The tension of strings 20 can be adjusted with thumbscrews 23 that are each geared to one of posts 22 and this allows a user to tune guitar 10 in a conventional manner. Guitar 10 further includes a fingerboard 24 that is supported by neck 14 and at least part of sound box 11 leading to sound hole 17. Fingerboard 24 is equipped with frets 25 and position marks 26 in accordance with conventional practice. Sound box 11 includes upper and lower bouts 30 and 31 and a waist 32 therebetween. Bout 30 defines opposing thumbs 30A and 30B, and bout 31 defines opposing thumbs 31A and 31B.

Figure 4:
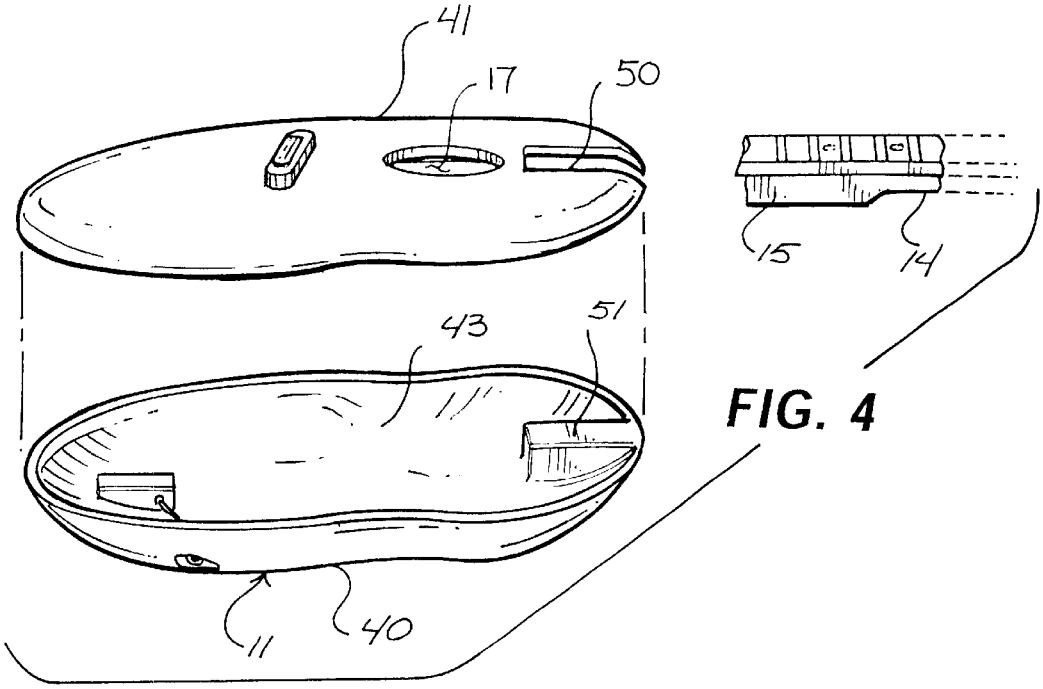
FIG. 4 is an exploded perspective view of the neck and sound box of the guitar of FIG. 1.
Figure 5:
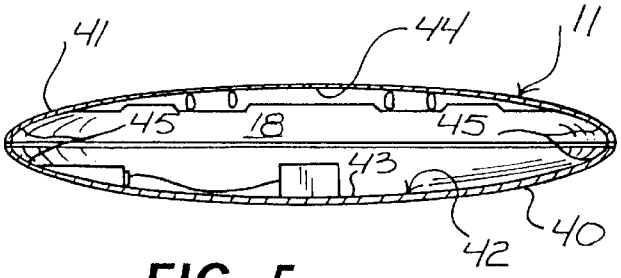
FIG. 5 is a sectional view taken along line 5—5 of FIG. 3.

Referring to FIG. 4, sound box 11 includes a generally bowl-shaped body 40 and a generally bowl-shaped sound board 41. As a matter of simple orientation, body 40 and sound board 41 are halves that when brought together and adhesively attached form sound box 11 as shown in FIG. 1. FIG. 5 illustrates a sectional view taken along line 5—5 of FIG. 2 and further illustrates sound board 41 attached to body 40. Body 40 and sound board 41 together define an inner surface designated generally with the reference character 42. Inner surface 42 defines and otherwise bounds sound chamber 18, and is a cooperation between a generally concave or bowl-shaped face 43 of body 40 and an opposing generally concave or bowl-shaped shaped face 44 of sound board 41 and a substantially continuous and parabolic face 45. Body 40 and sound board 41 are joined at their respective edges and are substantially coextensive with one another. Faces 43 and 44 meet at and together define parabolic face 45, which is located at the meeting point of the respective edges of body 40 and sound board 41 as shown and this meeting point is substantially continuous and broken only partially at the point where end 15 of neck 14 is attached as shown in FIGS. 1 and 2 and this will be discussed in more detail as this specification ensues.

In cross section, both along its width (at bouts 30 and 31 and waist 32) and length (from bout 30 to bout 31), sound chamber 18 is elongate and substantially ovoidal. Sound chamber 18 narrows at waist 32. The substantially ovoidal structural configuration of sound chamber 18 is very important because it provides a great deal of sound generation and carry as opposed to conventionally-shaped sound boxes of conventional guitars having flat sound boards. Because there are no sharp edges defining sound chamber 18, sound waves do not cancel back upon themselves and this contributes to the ability of sound box 11 to generate and carry sound. The generally ovoidal configuration of sound chamber 18 also serves to distribute sound radially and this maximizes the sound disbursement of sound box 11. As a matter of orientation, sound hole 17 is formed through sound board 41 as shown in FIG. 4.

Regarding FIG. 4, end 15 of neck 14 is received in a pocket or slot 50 formed into sound board 41 at its upper end as substantially shown. End 15 has no heel block, which allows a player to gain further access along neck toward sound box 11. Rather, body 40 supports a heel block 51 at its upper end that extends away from face 43. Heel block 51 can be a separate part attached to body 40 or machined, molded or otherwise integrally formed with body 40. Block 51 opposes pocket 50, and end 15 is fastened to block 51 with a conventional fastening apparatus such as screws and/or adhesive, and end 15 may also be keyed into block 51 if desired. The engagement of end 15 to sound board 41 and, more particularly, to pocket 50 is passive, in that there is no mechanical fastening of end 15 to sound board 41 other than the abutment of end 15 against those portions of sound board 41 that define pocket 50. This passive engagement is important, because it allows sound board 41 to resonate for a longer period of time and inhibits the resonation of sound board 41 from becoming absorbed by neck 14, which would otherwise happen if end 15 and pocket 50 were joined with a mechanical fastener or fasteners.

Turning now to FIG. 3, guitar 10 defines a central, longitudinal axis A from head 16 to lower end 13 of sound box 11. A pickup jack 60 is also shown. Jack 60 is a conventional device that is engagable by way of a cable to a speaker or sound amplifier. Jack 60 extends into or is otherwise associated with sound chamber 18, and it is operative for collecting and transmitting sound to the speaker or sound amplifier in accordance with conventional practice. Jack 60 can also be configured to amplify sound. What is different about jack 60 is its placement. In this embodiment, jack 60 is mounted to sound box 11 at the back or rear side of thumb 31B and offset relative to axis A and not mounted directly into lower end 13 of sound box 11 and substantially coincident with axis A as with conventional guitars. This placement of jack 60 is important for if a guitarist were to step on the cord attached to jack 60 it would pull down and out, and not twist and tear out the back of guitar 10 as on a tradition end-pin style jack. The positioning of jack 60 in FIG. 3 is for a guitarist who manages cords along neck 14 with his left hand and plays the strings with his right. For the guitarist who manages cords along neck 14 with his right hand and plays the strings with his left, jack 60 may be similarly positioned with thumb 31A.

The invention has been described above with reference to one or more preferred embodiments. However, those skilled in the art will recognize that changes and modifications may be made in the described embodiments without departing from the nature and scope of the invention. Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

What is claimed is:

1. A guitar comprising a neck including a head and an opposing end attached to a sound box and strings extending between the head and a bridge carried by the sound box, the sound box having a sound hole leading to a sound chamber that is defined by an inner surface comprising a generally concave sound board face and an opposing generally concave body face that meet at a substantially continuous and parabolic face.

2. The guitar of claim 1, wherein the neck includes a fingerboard opposing the strings.

3. The guitar of claim 1, the sound box defining a lower bout having opposing thumbs, wherein the sound box supports a pickup jack leading into one,of the thumbs.

4. The guitar of claim 1, wherein the opposing end of the neck is attached to a heel block carried by the sound box.

5. The guitar of claim 4, wherein the heel block is contained within the sound chamber.

6. A guitar comprising:

a neck including a head and an opposing end attached to a sound box and strings extending between the head and a bridge carried by the sound box, the sound box comprising joined, substantially bowl-shaped sound board and body halves that cooperate to define an inner surface of opposing generally concave sound board and body faces that meet at a substantially continuous and substantially parabolic face; and a sound hole leading to the sound chamber through the sound board half.

7. The guitar of claim 6, wherein the neck includes a fingerboard opposing the strings.

8. The guitar of claim 6, the sound box defining a lower bout having opposing thumbs, wherein the sound box supports a pickup jack leading into one of the thumbs.

9. The guitar of claim 6, wherein the opposing end of the neck is attached to a heel block carried by the sound box.

10. The guitar of claim 9, wherein the heel block is contained within the sound chamber.

11. A guitar comprising a neck including a head and an opposing end attached to a sound box and strings extending between the head and a bridge carried by the sound box, the sound box having a sound hole leading to a sound chamber having opposing thumb regions separated by a waist region, wherein the sound chamber is defined by an inner surface comprising a generally concave sound board face and an opposing generally concave body face that meet at a substantially continuous and parabolic face.

12. The guitar of claim 11, wherein the neck includes a fingerboard opposing the strings.

13. The guitar of claim 11, wherein the sound box supports a pickup jack leading into one of the thumb regions.

14. The guitar of claim 11, wherein the opposing end of the neck is attached to a heel block carried by the sound box.

15. The guitar of claim 14, wherein the heel block is contained within the sound chamber.

16. A guitar comprising:

a neck including a head and an opposing end attached to a sound box having a sound chamber including opposing thumb regions separated by a waist region, and strings extending between the head and a bridge carried by the sound box, the sound box comprising joined, substantially bowl-shaped sound board and body halves that cooperate to define an inner surface that defines the sound chamber, the inner surface including opposing generally concave sound board and body faces that meet at a substantially continuous and substantially parabolic face; and a sound hole leading to the sound chamber through the sound board half.

17. The guitar of claim 16, wherein the neck includes a fingerboard opposing the strings.

18. The guitar of claim 16, the sound box defining a lower bout having opposing thumbs, wherein the sound box supports a pickup jack leading into one of the thumbs.

19. The guitar of claim 16, wherein the opposing end of the neck is attached to a heel block carried by the sound box.

20. The guitar of claim 16, wherein the heel block is contained within the sound chamber.

21. A guitar comprising:

a neck including a head and an opposing end attached to a sound box and strings extending between the head and a bridge carried by the sound box;

the sound box comprising a generally bowl-shaped body and an attached, generally bowl-shaped sound board that together cooperate and define a sound chamber, the sound board having a sound hole leading to the sound chamber.

22. The guitar of claim 21, wherein the neck includes a fingerboard opposing the strings.

23. The guitar of claim 21, the sound box defining a lower bout having opposing thumbs, wherein the sound box supports a pickup jack leading into one of the thumbs.

24. The guitar of claim 21, wherein the opposing end of the neck is attached to a heel block carried by the sound box.

25. The guitar of claim 24, wherein the heel block is contained within the sound chamber.

26. The guitar of claim 1, wherein the sound chamber is defined by a cooperation between an inner surface of the generally bowl-shaped body and a generally arcuate inner surface of the sound board.

* * * * *